US010011453B1

(12) United States Patent
Dufort et al.

(10) Patent No.: US 10,011,453 B1
(45) Date of Patent: Jul. 3, 2018

(54) CLOSED-LOOP STACKER CONTROL USING STACK TOPOGRAPHY TO AVOID JAMS

(71) Applicant: XEROX CORPORATION, Norwalk, CT (US)

(72) Inventors: Ron E Dufort, Rochester, NY (US); Steven R Moore, Pittsford, NY (US); Timothy D Slattery, Elma, NY (US); Erwin Ruiz, Rochester, NY (US); Charles J Bennett, Hilton, NY (US); Linn C Hoover, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/685,232

(22) Filed: Aug. 24, 2017

(51) Int. Cl.

| | |
|---|---|
| ***B65H 31/10*** | (2006.01) |
| ***B65H 31/36*** | (2006.01) |
| ***B65H 43/06*** | (2006.01) |
| ***B65H 31/12*** | (2006.01) |
| ***B65H 31/28*** | (2006.01) |
| ***B65H 7/20*** | (2006.01) |

(52) U.S. Cl.
CPC ..... *B65H 31/10* (2013.01); *B65H 7/20* (2013.01); *B65H 31/12* (2013.01); *B65H 31/28* (2013.01); *B65H 31/36* (2013.01); *B65H 43/06* (2013.01); *B65H 2511/152* (2013.01)

(58) Field of Classification Search
CPC ..... B65H 31/36; B65H 31/12; B65H 31/10; B65H 2511/152; B65H 31/34
See application file for complete search history.

(56) References Cited

U.S. PATENT DOCUMENTS

| | | | | |
|---|---|---|---|---|
| 7,267,337 | B2 * | 9/2007 | Moore | B65H 1/18 271/148 |
| 7,913,995 | B2 * | 3/2011 | Clark | B65H 1/14 271/126 |
| 8,191,889 | B1 * | 6/2012 | Cummings | B65H 1/08 271/147 |
| 2005/0224731 | A1 * | 10/2005 | Hahn | B65H 7/14 250/556 |
| 2006/0284366 | A1 * | 12/2006 | Van Dongen | B65H 1/08 271/148 |

(Continued)

*Primary Examiner* — Patrick D Cicchino

(57) ABSTRACT

A sheet stacking system is disclosed that has improved tolerance for sheets that are not flat. Successive sheets are aligned onto a stack by a plurality of registration belts. The heights of the pivoting registration belts are compared with one another to determine the unevenness of the top of the stack. This unevenness is represented by the difference between the heights of the highest and lowest registration belt $\Delta_{stack\text{-}height}$ and is monitored to quantify the planarity of the top of the stack. When the unevenness ($\Delta_{stack\text{-}height}$) exceeds a threshold, the system switches to a modified method to control the elevation of the stack. This method may include stopping the machine from stacking before the unevenness is too large for the registration belts to uniformly drive sheets. This invention prevents the stacker from attempting to stack when sheets are expected to skew thereby preventing jams and unusable stacks.

7 Claims, 7 Drawing Sheets

(56) References Cited

U.S. PATENT DOCUMENTS

2007/0257419 A1* 11/2007 Wilcox ..... B65H 1/14
271/148
2011/0215520 A1* 9/2011 Tsuchiya ..... B65H 31/12
271/209

* cited by examiner

CLOSED-LOOP STACKER CONTROL USING STACK TOPOGRAPHY TO AVOID JAMS

FIELD OF THE DISCLOSURE

The disclosure relates to media or sheet processing. In particular, the disclosure relates to substrate stacker trays in media processing systems which are utilized in digital printing systems.

BACKGROUND

Digital printing systems can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format. More development is underway of production printers that require inkjet direct marking onto cut sheet media. This includes UV curable inks, solid inks and aqueous inks.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. These output sheets are transported to a stacker.

The purpose of the stacker is to compile printed sheets into a well-formed stack suitable to user end requirements, such as off-line finishing or bulk distribution. Current production printers are equipped with a high capacity stacker that produces a stack in which sheets can be optionally offset to one of two positions in the cross-process direction. It is desirable to have a stacker effective and reliable at speeds of at least 110 ppm or more.

A problem in a sheet stacking system utilizing a plurality of registration belts to align successive sheets onto the top of a stack is the development of high spots in the stack. High spots on a stack can progressively build up due to sheet curl, cockle, and edge damage. If a high spot on a stack develops, then the drive force imparted to successive sheets by the plurality of registration belts may become non-uniform, which results in sheets to be poorly aligned on top of the stack, resulting in an undesirable stack. Further, if the high spot builds to a sufficient level in which one or more registration belts completely lose contact with the top of the stack, then this results in an asymmetric loss of drive leading to skewed sheets and jams in the stacker.

Currently, to prevent this type of skew from occurring, the operator must have prior knowledge that a given print job will build up a stack with a high spot, and then manually limit the stack height, thereby keeping the high spots from building up beyond the latitude of the stacker.

SUMMARY OF THE INVENTION

There is provided a sheet stacking system for stacking a plurality of sheets from a printed sheets output path into a sheet stacking tray. The sheet stacking system includes a sheet transport assembly for feeding sheets from a sheet entrance path into said sheet stacking tray by which the printed sheets are fed into said sheet stacking tray to be stacked on top of sheets previously stacked in said sheet stacking tray. The sheet stacking tray includes an elevator for lowering said sheet stacking tray in relation to said sheet entrance path to maintain a predefined elevation of a top surface of said printed sheets stacked in said sheet stacking tray and a stack height sensing system that includes a stack height sensor for detecting the height of the stack of printed sheets stacked in said sheet stacking tray. The stack height sensing system includes means for sensing an unevenness value of the top surface of said printed sheets stacked in said sheet stacking tray. The stack height sensing system provides a control signal when said unevenness value of said printed sheets stacked in said sheet stacking tray reaches a threshold value which would obstruct said sheet entrance path to said sheet stacking or misalign sheets in said sheet stacking tray. The sheet stacking system includes means for modifying the elevation of the top surface of said printed sheets stacked in said sheet stacking tray, said modifying means being responsive to said control signal to adjust said elevator when said unevenness value reaches said threshold value.

BRIEF DESCRIPTION OF THE DRAWINGS

The present disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity.

DETAILED DESCRIPTION

In the following description, various aspects of the illustrative implementations will be described using terms commonly employed by those skilled in the art to convey the substance of their work to others skilled in the art. However, it will be apparent to those skilled in the art that the present disclosure may be practiced with only some of the described aspects. For purposes of explanation, specific numbers, materials, and configurations are set forth in order to provide a thorough understanding of the illustrative implementations. However, it will be apparent to one skilled in the art that the present disclosure may be practiced without the specific details. In other instances, well-known features are omitted or simplified in order not to obscure the illustrative implementations.

Figure 1:
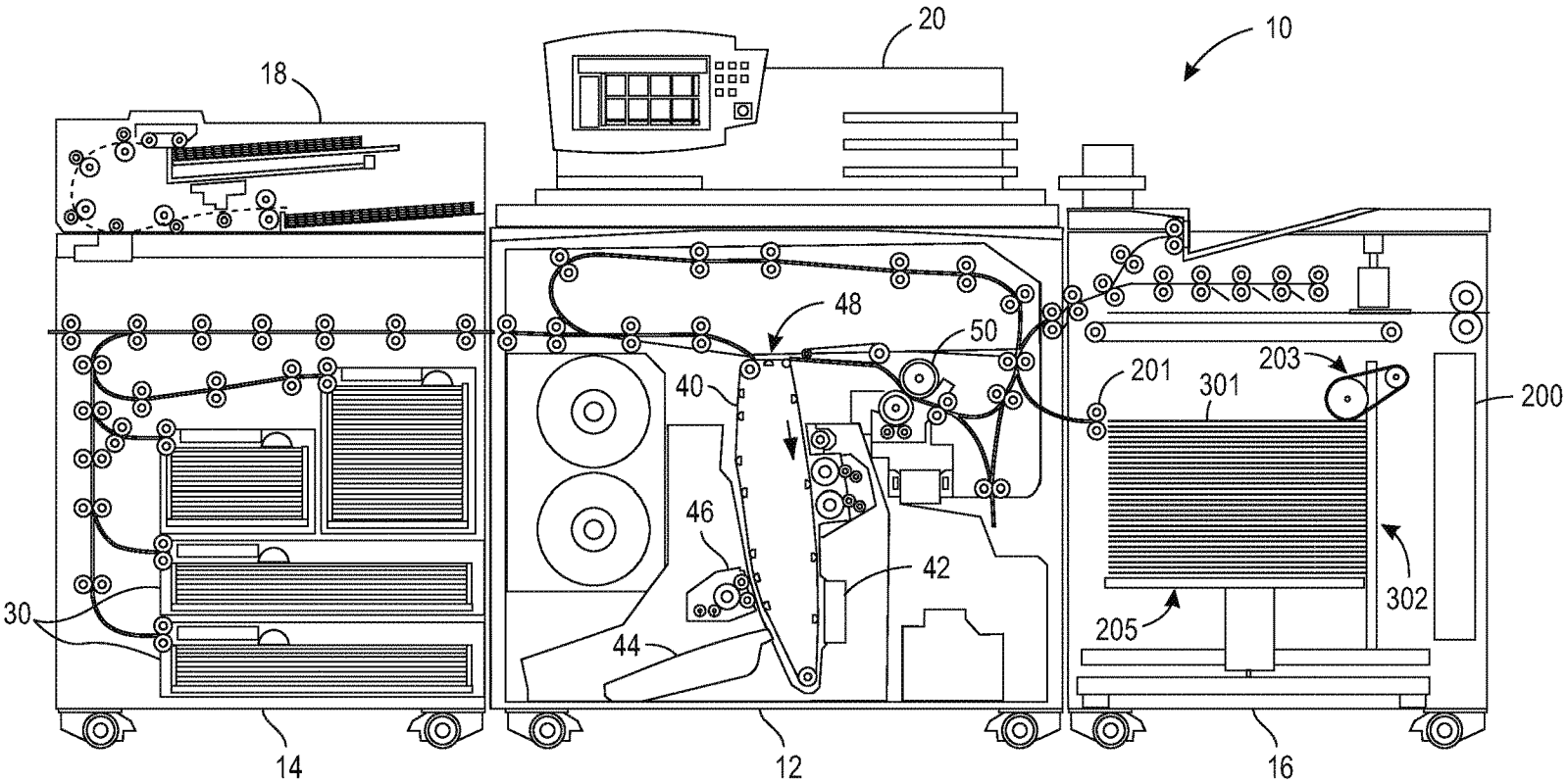
FIG. 1 illustrates schematic of an example of a digital imaging system, which can be employed by the present invention.

With reference to FIG. 1, there is shown an elevational view of a basic document creating apparatus 10 for creating documents and incorporating aspects of the present exemplary embodiment. Although the present exemplary embodiment will be described with reference to the single embodiment shown in the drawings, it should be understood that the present exemplary embodiment can be embodied in many alternate forms of embodiments. In addition, any suitable size, shape or type of elements or materials could be used. A copying or printing system of the type shown is preferably adapted to provide duplex or simplex stacked document sets from duplex or simplex collated document or print sets which result from either duplex or simplex original documents or output document computer files for print. The document creating apparatus 10, in the embodiment shown, is a copier. However, in an alternate embodiment, the apparatus could be a printer or any other suitable type of document creating apparatus.

In this embodiment, the apparatus 10 includes a printing engine 12, which includes hardware by which image signals are used to create a desired image, as well as a substrate feeder module 14, which stores and dispenses substrates (or sheets) upon which images are to be printed, and a finisher 16, which may include hardware for stacking, folding, stapling, binding, etc., prints which are output from the printing engine 12. It is to be understood, however, that although the feeder 14 is shown as a separate module, it may also be disposed within the printing engine 12 or some other part of the apparatus 10, as known in the art. If the apparatus 10 is also operable as a copier, the apparatus 10 further includes a document feeder 18, which operates to convert signals from light reflected from original hard-copy image into digital signals, which are in turn processed to create copies with the printing engine 12. The apparatus 10 may also include a local user interface 20 for controlling its operations, although another source of image data and instructions may include any number of computers to which the printer is connected via a network. The user interface 20 may include a touch screen for making selections or it can be operated by means of a keyboard and mouse.

With reference to the substrate feeder module 14, the module includes any number of feeder assemblies 30, each of which stores print sheets ("stock") of a predetermined type (size, weight, color, coating, transparency, etc.) in a tray and includes a feeder to dispense one of the sheets therein as instructed. The feeder may be a shuttle feeder, a vacuum corrugated feeder which utilizes air pressure to feed the sheets or other known types of feeders. Certain types of stock may require special handling in order to be dispensed properly. For example, heavier or larger stocks may desirably be drawn from a stack by use of an air knife, fluffer, vacuum grip or other application (not shown) of air pressure toward the top sheet or sheets in a stack. Certain types of coated stock are advantageously drawn from a stack by the use of an application of heat, such as by a stream of hot air (not shown) or other means. Sheets drawn from a selected tray 30 are then moved to the printing engine 12 to receive one or more images thereon.

In this embodiment, the printing engine 12 is a monochrome xerographic type, although other types of engine, such as color xerographic, ionographic, or ink-jet may be used. In FIG. 1, the printing engine 12 includes a photoreceptor 40, here in the form of a rotatable belt. The photoreceptor 40 is an example of what can be called a "rotatable image receptor," meaning any rotatable structure such as a drum or belt which can temporarily retain one or more images for printing. Such an image receptor can comprise, by way of example and not limitation, a photoreceptor, or an intermediate member for retaining one or more ink or toner layers for subsequent transfer to a sheet, such as in a color xerographic, offset, or ink-jet printing apparatus. The photoreceptor 40 is entrained on a number of rollers, and a number of stations familiar in the art of xerography are placed suitably around the photoreceptor 40, such as a charging station 42, an imaging station 44, a development station 46, and a transfer station 48. In this embodiment, the imaging station 44 is in the form of a laser-based raster output scanner, of a design familiar in the art of "laser printing," in which a narrow laser beam scans successive scan lines oriented perpendicular to the process direction of the rotating photoreceptor 40. The laser is turned on and off to selectably discharge small areas on the moving photoreceptor 40 according to image data to yield an electrostatic latent image, which is developed with toner at the development station 46 and transferred to a sheet at the transfer station 48.

There are also various motors that feed sheets from a stack in the feeder assembly 30 through the machine that can be readily controlled, whether they are AC, DC, or servo motors, to operate at a certain speed, depending on the desired output speed, which of course directly affects the rotational speed of the photoreceptor 40.

A sheet having received an image in this way is subsequently moved through a fuser 50, of a general design known in the art, and the heat and pressure from the fuser causes the toner image to become substantially permanent on the sheet. For duplex or two-sided printing, the printed sheet can then be inverted and re-fed past the transfer station 48 to receive a second-side image. The finally-printed sheet is then moved to finisher module 16, where it may be collated, stapled, folded, etc., with other sheets in methods familiar in the art.

The finisher module 16 of the current invention has a sheet stacking system 200 to compile printed sheets into a well-formed stack suitable to user end requirements. It has many control parameters that are "fixed" during the design stage along with some that are variable and controlled through the machine software.

Figure 2:
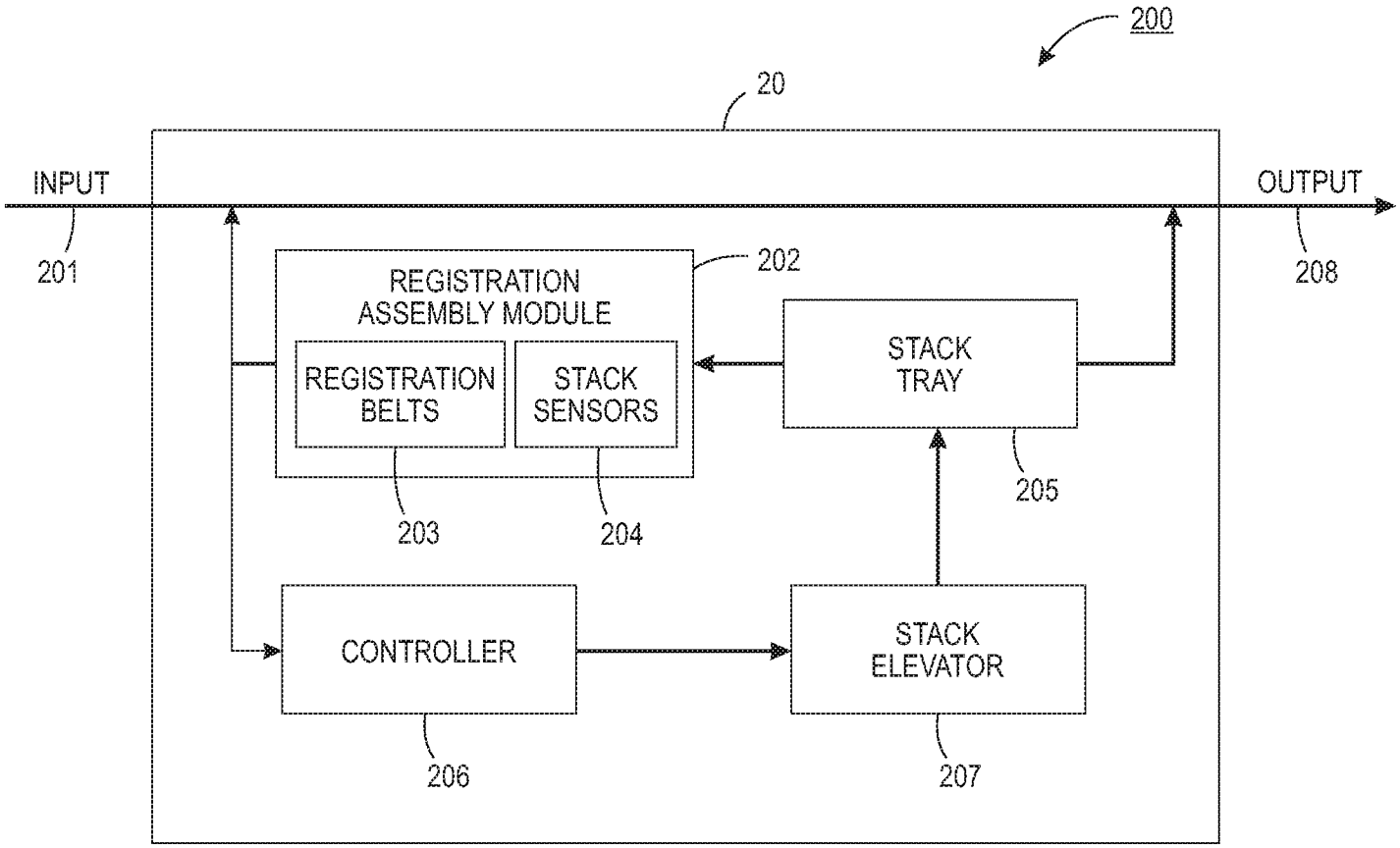
FIG. 2 Illustrates a functional block diagram of the stacking system.
Figure 3:
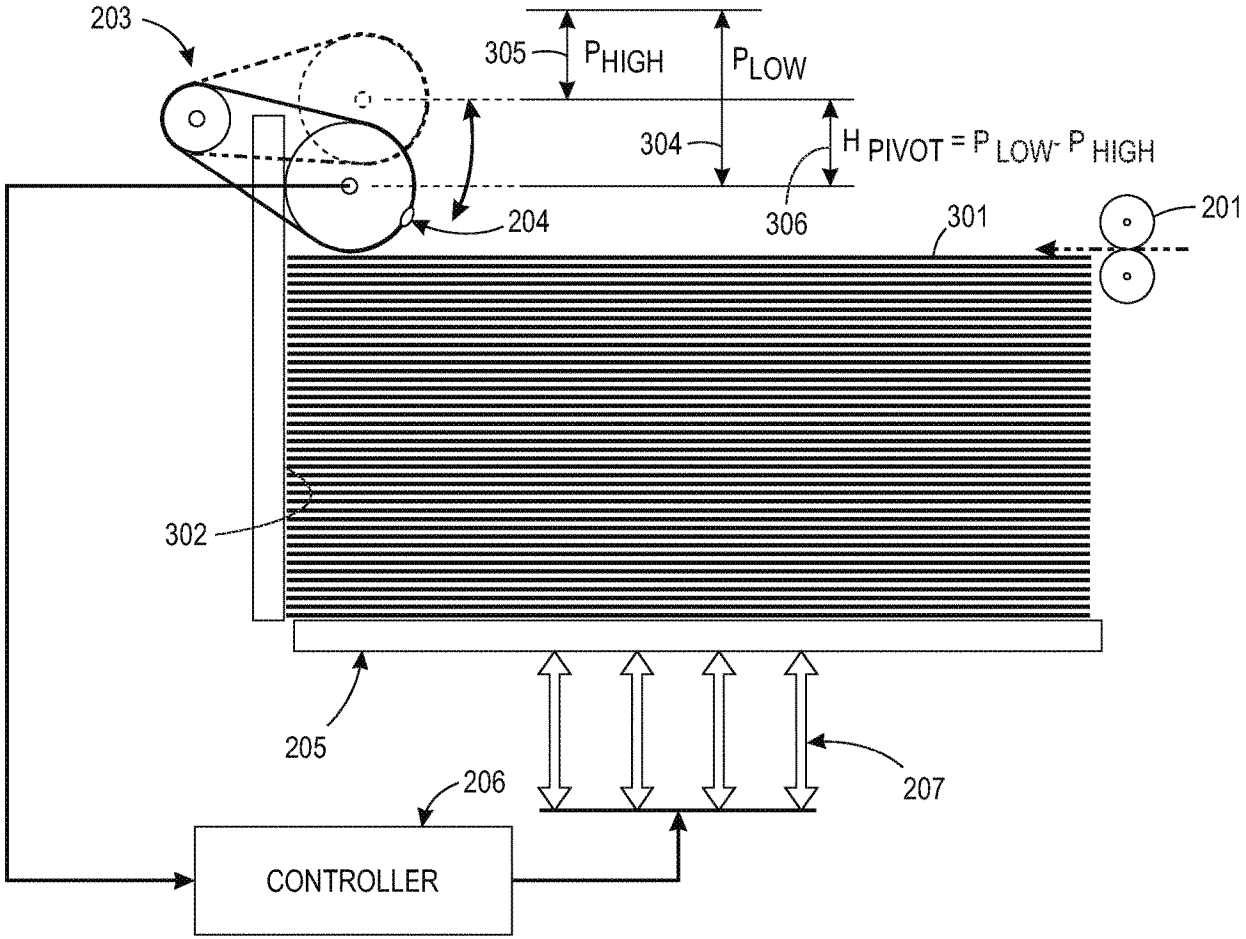
FIG. 3 illustrates a side view of the sheet stacking system.

Turning next to FIG. 2 and FIG. 3, in which FIG. 2 illustrates a functional block diagram and FIG. 3 illustrative view of the sheet stacking system 200 of the present invention. The sheet stacking system 200 is part of a finisher module 16 which receives input feed 201 from printer engine 12. The sheet stacking system 200 includes a registration assembly module 202 which further comprises of registration belts 203 and stack sensors 204 and also a stack tray 205 which is able to accommodate various sheet sizes and types. Input feed 201 delivers successive sheets to registration belts 203 which in turn align them onto the top of the stack. The sheet stacking system 200 further comprises of stack sensors 204 which detects the height of the uppermost sheet of paper on stack tray 205 The stack sensors 204 measure the position of the registration belts 203 and send the measured signals to the controller 206. Depending on the signals received from the stack sensors 204, the controller 206 adjusts the position of the stack tray 205 using the stack elevator 207. The various machine functions of the stack sheeting system 200 are regulated by controller 206. The controller 206 is preferably a programmable microprocessor which controls all of the functions of sheet stacking system 200 hereinbefore described. The control of all of the exemplary systems heretofore described may be accomplished by conventional control switch inputs from the printing machine local user interface selected by the operator. Depending on the signal received from the controller 206, the stack elevator can raise or lower the stack tray 205.

FIG. 3 illustrates the operation of the registration belts 203 of the registration assembly module 202 of the sheet stacking system 200. The registration belts 203 engage the top of the stack 301, sheets are transported over the stack 301 by input feed 201 and then oriented by being pushed against a registration wall 302 by plurality of registration belts 203. Even though there are a plurality of registration belts 203 as part of the sheet registration module 202, only one is shown for illustrative purposes. Registration belts 203 on an assembly (not shown) may pivot and move up slightly as each new sheet is added, thus making room for new sheets while still maintaining a consistent drive force on successive incoming sheets. The registration belts 203 can be displaced a pivot distance of $H_{pivot}$ 306 which is the difference between $P_{high}$ 305 and Plow 304 to maintain contact with the top of the stack 301 as sheets are added and as the stack is lowered by stack elevator 207. The stack sensors 204 measure the vertical position of the registration belts 203 to determine the difference in the stack height at various locations of the stack 301. As long as the difference in the stack height at various locations of the stack 301 is less than the $H_{pivot}$ 306, the stack sheeting system 200 can continue with the printing.

Figure 4:
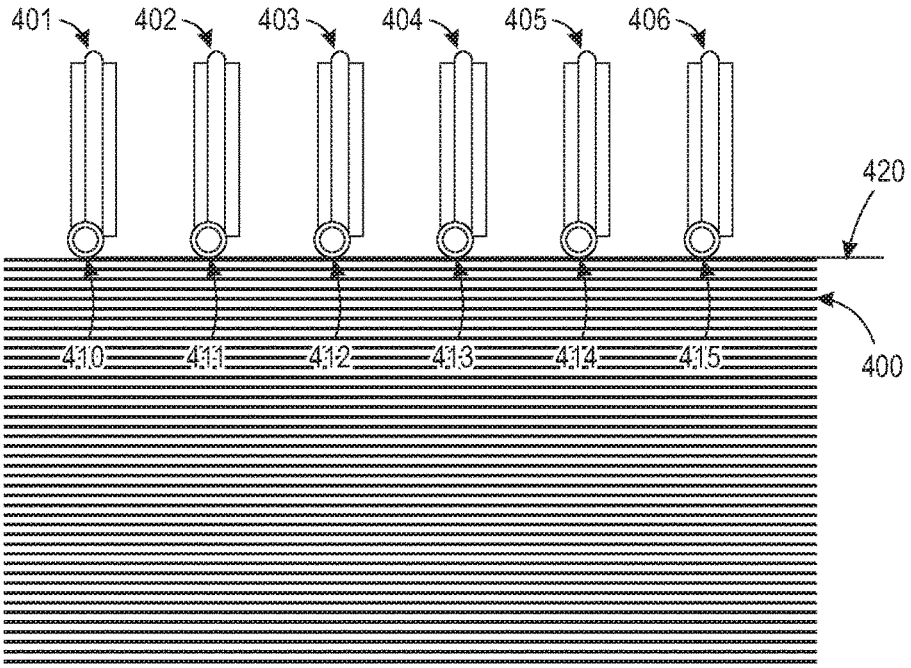
FIG. 4 illustrates a front view of the sheet stacking system in a mode of operation of the present invention.

FIG. 4 illustrates one embodiment of the invention when the registration belts 401-406 of the sheet stacking system 200 engage with the flat stack 400. Stack-height sensors 410-415 measure the vertical position of each of the plurality of the registration belts 401-406. The registration belts 401-406 all engage the flat stack 400 at roughly the same horizontal plane and the difference in the height of the stack 400 at various locations of the stack, $\Delta_{stack\text{-}height}$ 420 is zero. Registration belts 401-406 elevator at approximately the same time as sheets are added, and lower at approximately the same time when the flat stack 400 is lowered. Again, when the flat stack 400 is lowered, the registration belts 401-406 all lower roughly together and all maintain contact with the top of the flat stack 400 and provide even drive and good registration.

Figure 5:
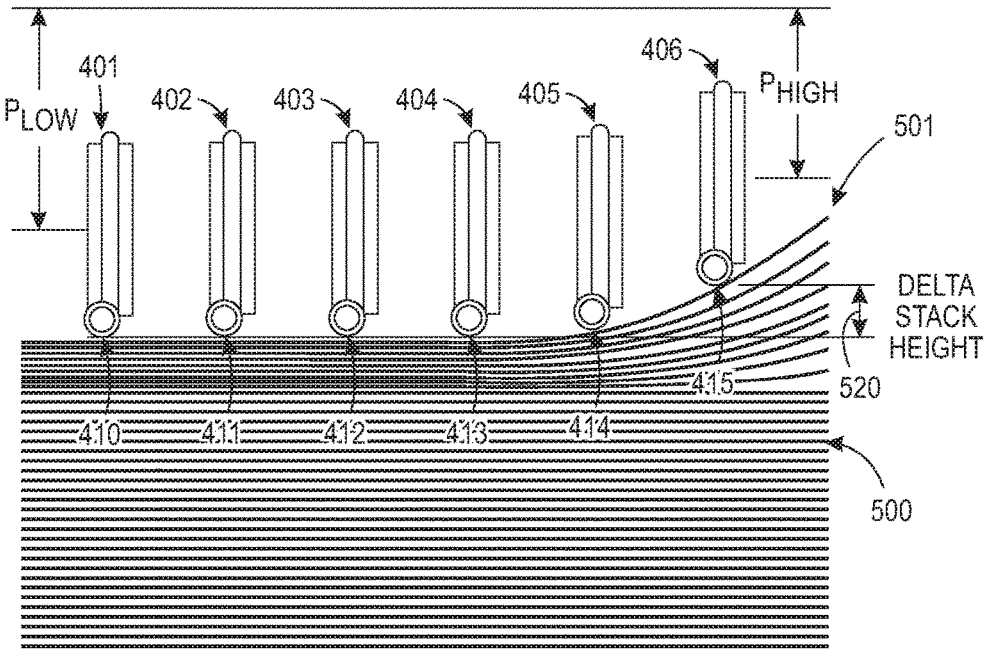
FIG. 5 illustrates a front view of the sheet stacking system in another mode of operation of the present invention.

FIG. 5 illustrates one embodiment of the invention when the registration belts 401-406 of the sheet stacking system 200 engage with the uneven stack 500. Stack-height sensors 410-415 measure the vertical position of each of the plurality of the registration belts 401-406. With an uneven stack 500, difference in the height of the stack 400 at various locations of the stack, $\Delta_{stack\text{-}height}$ 520 is large, the registration belts 401-406 all can't engage the uneven stack 500 at the same time. The difference between the sensor readings from the highest stack-height sensor 415 and the lowest stack-height sensor 410 is the measure of the unevenness, i.e., the height of the high-spot 501. If conditions for developing a high spot 501 exist, the high spot may continue to build up higher as the uneven stack 500 grows; the top of the stack becomes even more uneven, further increasing $\Delta_{stack\text{-}height}$ 520. At least one of the registration belts 401-403 may reach a point where it no longer stays engaged with the uneven stack 500 causing a loss of uniform drive force of the registration belts 401-406 on the incoming sheet.

Figure 6:
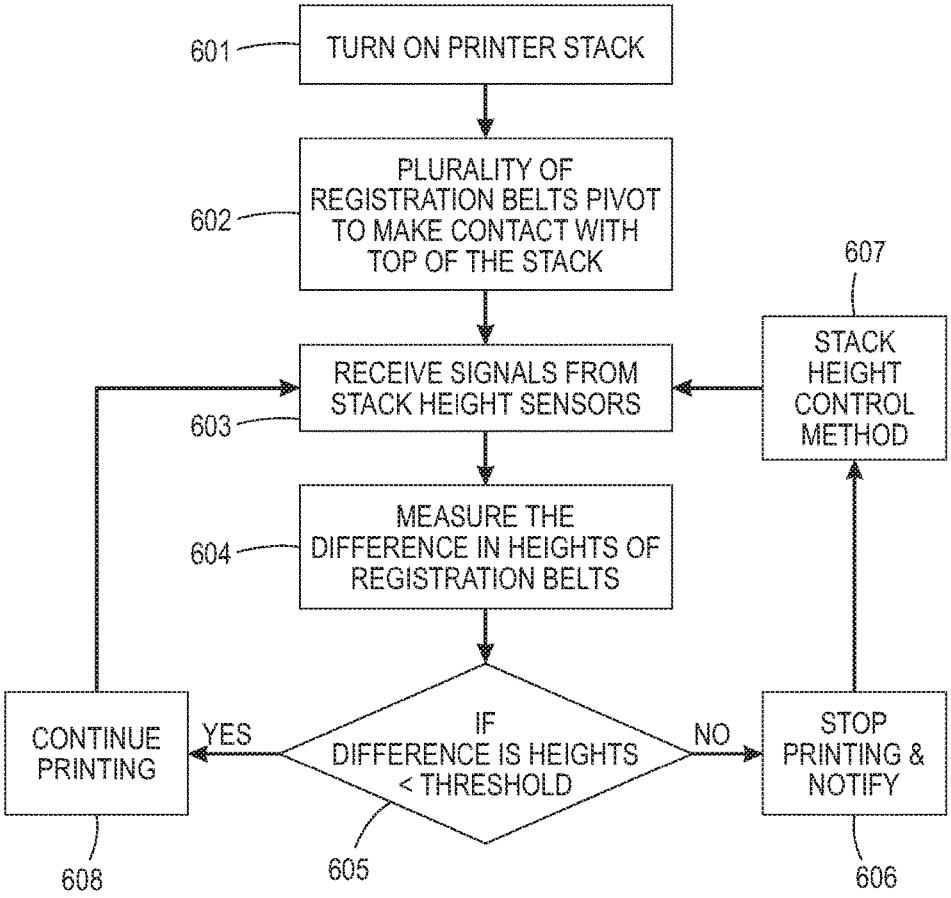
FIG. 6 illustrates a flow diagram of the operation of sheet stacking system of the present invention.
Figure 7:
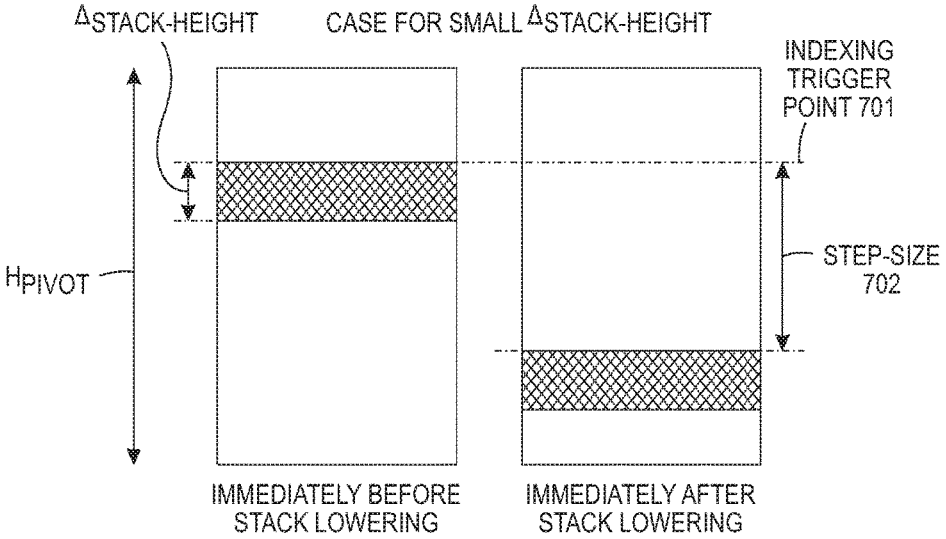
FIG. 7 illustrates a method of monitoring the height of stack and generating the trigger and adjusting step size when the difference of stack height is small at the top of the stack according to the present invention.

FIG. 6 illustrates the flow diagram of the operation of sheet stacking system 200. When the sheet stacking system 200 is turned ON (step 601), the plurality of the registration belts 401-406 pivot to make contact with the top of the stack 400 (step 602). The stack height sensors 410-415 measure the vertical heights of the registration belts 401-406 (step 603). The output from the stack-height sensors 410-415 is used to calculate $\Delta_{stack\text{-}height}$ 420 which directly correlates to a stack condition that results in a loss of drive and skew (step 604). The difference in heights $\Delta_{stack\text{-}height}$ 420 of the registration belts 401-406 is compared with a predefined pivot threshold $H_{pivot}$ 306 (step 605). If the difference in heights of the registration belts 401-406 is under a predefined threshold, printing is continued (i.e, new sheets are added to stack) (step 608). If the difference in heights of the registration belts 401-406 is equal or more than the predefined threshold, printing is stopped and stacking system issues a notification (step 606) and the stack height control method is modified (step 607). For example, as shown in FIG. 4, when the registration belts 401-406 come in contact with the flat stack 400, the difference $\Delta_{stack\text{-}height}$ 420 in the heights of the registration belts 401-406 measured by the stack height sensors 410-415 is very low (step 605) and the printing is continued. However, when the registration belts 401-406 come in contact with the uneven stack 500 as shown in FIG. 7, the difference in the heights $\Delta_{stack\text{-}height}$ 520 of the registration belts 401-406 measured by the stack height sensors 410-415 may be large. The stack height control method will be modified to better maintain contact between all registration belts 401-406 and the stack (Step 607) by controller 206. When $\Delta_{stack\text{-}height}$ 420 is below the set threshold the system continues printing and the outputs from the stack-height sensors 401-406 are monitored continuously by controller 206. As the sheets get stacked on the top of the stack 400, the $\Delta_{stack\text{-}height}$ 520 approaches a threshold, then the system declares a status or fault condition which results in a controlled "soft stop" and printing is stopped and stack tray 205 may be lowered (step 605, step 606).

In one embodiment of the invention as sheets are stacked, the stack 400 gets higher and the registration belts 401-406 pivot up—when one of the belt has pivoted as far up as is physically possible or a predefine pivot point, the stack 301 is lowered by controller 206 so more sheets can be added; the stack 301 is lowered until the registration belts 401-406 has pivoted to the bottom of its range.

In another embodiment of the invention stacks that exhibit significant convexity or concavity, i.e., the center is either higher or lower than the corners, will stack better for the same $\Delta_{stack\text{-}height}$ than stacks with asymmetric high spots, such as the case with a high IB corner and a low OB corner. This symmetric condition can be detected by noting which sensors are at their high/low values. An alternate threshold is then set for those cases so that the system can take advantage of that additional stacking latitude; for example, when symmetry is noted, the system issues a warning signal to local user interface 20 when the stack reaches $\Delta_{stack\text{-}height}$-MAX but continues printing/stacking; the warning could be simply for the operator to take a look at the stack and verify it is being formed correctly.

Figure 8:
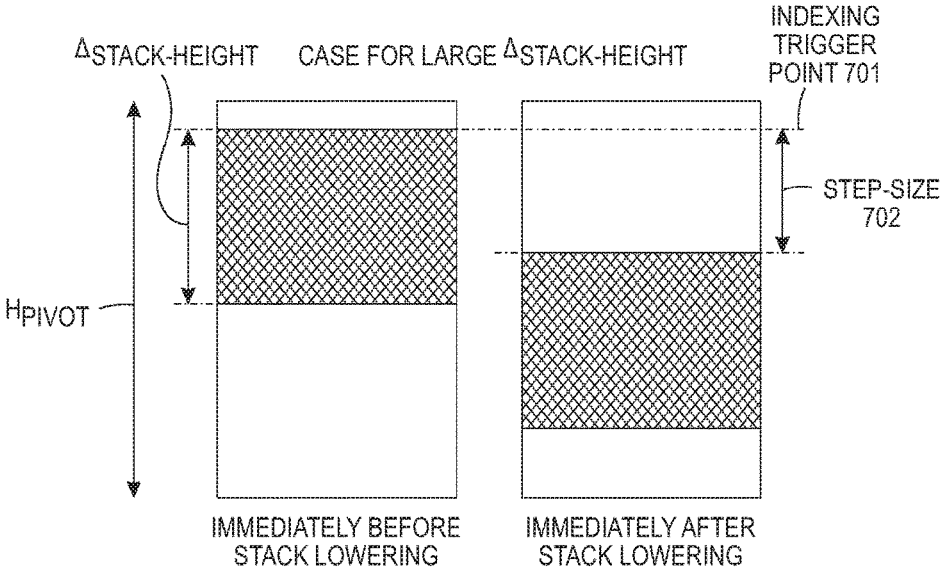
FIG. 8 illustrates a method of monitoring the height of stack and generating the trigger and adjusting step size when the difference of stack height is large at the top of the stack according to the present invention.

FIG. 7 and FIG. 8 illustrate the other embodiments of the invention where the sheet stacking system 200 may monitor the height detected by the stack height sensors 410-415 $\Delta_{stack\text{-}height}$ continuously and make the "indexing trigger" and "step-size" parameters into functions of $\Delta_{stack\text{-}height}$ and $\Delta_{stack\text{-}height}$ value to trigger a change those parameters. The indexing trigger is the signal that instructs the elevator to start lowering the stack and the step-size is the signal that instructs the elevator the distance to lower the stack. FIG. 7 illustrates one embodiment of the invention when the $\Delta_{stack\text{-}height}$ is small, the index is triggered by the sheet stacking system 200. If the top of the stack 301 is not closer to the top of the range of the pivot, the indexing step size can be large. FIG. 8 illustrates one embodiment of the invention when the $\Delta_{stack\text{-}height}$ is large and the top of the stack 301 is closer to the top of the range of the pivot, the index is triggered and the indexing step size is reduced to prevent the registration belts 401-406 to move below the range.

It will be appreciated that variants of the above-disclosed and other features and functions, or alternatives thereof, may be combined into many other different systems of applications. Various presently unforeseen or unanticipated alternatives, modifications, variations, or improvements therein may be subsequently made by those skilled in the art which are also intended to be encompassed by the following claims.

What is claimed is:

1. In a sheet stacking system for stacking a plurality of sheets from a printed sheets output path into a sheet stacking tray, comprising:

a sheet transport assembly for feeding sheets from a sheet entrance path into said sheet stacking tray by which the printed sheets are fed into said sheet stacking tray to be stacked on top of sheets previously stacked in said sheet stacking tray;

said sheet stacking tray including an elevator for lowering said sheet stacking tray in relation to said sheet entrance path to maintain a predefine elevation from a top surface of said printed sheets stacked in said sheet stacking tray;

a stack height sensing system for detecting the height of the stack of printed sheets stacked in said sheet stacking tray, said stack height sensing system includes means for sensing an unevenness value of the top surface of said printed sheets stacked in said sheet stacking tray, said stack height sensing system providing a control signal when said unevenness value of said printed sheets stacked in said sheet stacking tray reaches a threshold value which would obstruct said sheet entrance path to said sheet stacking tray or misalign sheets in said sheet stacking tray; and a controller for modifying the predefine elevation of the top surface of said printed sheets stacked in said sheet stacking tray, said controller means being responsive to said control signal to adjust said elevator when said unevenness value reaches said threshold value.

2. A sheet stacking system of claim 1, wherein said sheet transport assembly comprising:

a first registration belt configured to contact the top surface of said printed sheets stacked in said sheet stacking tray at a first location in the stacking tray; and a second registration belt configured to contact the top surface of said printed sheets stacked in said sheet stacking tray at a second location in the stacking tray.

3. A sheet stacking system of claim 2, wherein said stack height sensing system further comprising:

a first sensor associated with the first registration belt and configured to measure a first height of the stack of printed sheets stacked in said sheet stacking tray at the first location in the stacking tray; and a second sensor associated with the second registration belt and configured to measure a second height of the stack of printed sheets stacked in said sheet stacking tray height at the second location in the stacking tray.

4. A sheet stacking system of claim 3, wherein said stack height sensing system compares a difference in the first height and the second height to determine the unevenness value of the top surface of said printed sheets stacked in said sheet stacking tray.

5. A sheet stacking system of claim 4, wherein the unevenness value is less than a predetermined threshold, the controller adjusts step size and indexing trigger to maintain both said first registration belt and said second registration belt in contact with the top surface of said printed sheets.

6. A sheet stacking system of claim 4, wherein the unevenness value is greater than a predetermined threshold, the controller halts feeding sheets.

7. A sheet stacking system of claim 4, where in the unevenness value is greater than a predetermined threshold, the controller stops operation of the sheet stacking system.

* * * * *